US011413483B2

(12) United States Patent
Wilkins

(10) Patent No.: US 11,413,483 B2
(45) Date of Patent: Aug. 16, 2022

(54) ELECTRONIC ACCELERATOR FOR AUTOMATIC WATER CONTROL VALVES

(71) Applicant: Tyco Fire Products LP, Lansdale, PA (US)

(72) Inventor: Roger S. Wilkins, Warwick, RI (US)

(73) Assignee: Tyco Fire Products LP, Lansdale, PA (US)

( * ) Notice: Subject to any disclaimer, the term of this patent is extended or adjusted under 35 U.S.C. 154(b) by 404 days.

(21) Appl. No.: 16/592,958

(22) Filed: Oct. 4, 2019

(65) Prior Publication Data

US 2020/0108284 A1 Apr. 9, 2020

Related U.S. Application Data

(60) Provisional application No. 62/741,995, filed on Oct. 5, 2018.

(51) Int. Cl.
*A62C 35/66* (2006.01)

(52) U.S. Cl.
CPC ..... *A62C 35/66* (2013.01)

(58) Field of Classification Search
CPC ..... A62C 35/645; A62C 35/66; A62C 35/68
See application file for complete search history.

(56) References Cited

U.S. PATENT DOCUMENTS 5,992,532 A * 11/1999 Ramsey ..... A62C 37/36 169/17
6,557,645 B1 5/2003 Ringer
7,793,736 B2 9/2010 Golinveaux et al.
9,987,509 B1 6/2018 Asselin
2002/0121381 A1* 9/2002 Reilly ..... A62C 37/46 169/14
2004/0011537 A1* 1/2004 Jackson ..... A62C 35/68 169/19
2010/0071776 A1* 3/2010 Ringer ..... A62C 35/68 137/12
2016/0279454 A1 9/2016 Ringer et al.
2017/0225021 A1* 8/2017 Williams ..... F16K 15/033

FOREIGN PATENT DOCUMENTS

WO WO-2016/022497 2/2016

OTHER PUBLICATIONS

International Search Report and Written Opinion on PCT PCT/IB2019/058480, dated Dec. 5, 2019, 14 pages.

* cited by examiner

*Primary Examiner* — Ryan A Reis
(74) *Attorney, Agent, or Firm* — Foley & Lardner LLP

(57) ABSTRACT

An electronic accelerator includes a pressure sensor, a first control valve, and a control circuit. The pressure sensor detects a pressure in a fluid supply line between a fluid supply and at least one sprinkler head. The first control valve is coupled to a second control valve that when open permits fluid to flow from the fluid supply to the at least one sprinkler head. The control circuit receives the pressure detected by the pressure sensor, determines the at least one sprinkler head to be open based on the pressure detected by the pressure sensor, and in response causes the first control valve to open to reduce a chamber pressure in a chamber of the second control valve to cause the second control valve to open to permit fluid to flow from the fluid supply through the fluid supply line to the at least one sprinkler head.

12 Claims, 3 Drawing Sheets

ELECTRONIC ACCELERATOR FOR AUTOMATIC WATER CONTROL VALVES

CROSS-REFERENCE TO RELATED APPLICATIONS

The present disclosure claims the benefit of and priority to U.S. Provisional Application No. 62/741,995, titled "ELECTRONIC ACCELERATOR FOR AUTOMATIC WATER CONTROL VALVES," filed Oct. 5, 2018, the disclosure of which is incorporated herein by reference in its entirety.

BACKGROUND

Automatic water control valves can be used in fire sprinkler systems to automatically control the flow of fluid outputted by the fire sprinklers systems. For example, automatic water control valves can be used to allow fluid to be outputted when a fire condition has been detected.

SUMMARY

One implementation of the present disclosure is an electronic accelerator, which may be used to accelerate operation of devices including but not limited to automatic water control valves. The electronic accelerator includes a pressure sensor, a first control valve, and a control circuit. The pressure sensor is coupled to a fluid supply line to detect a pressure in the fluid supply line. The fluid supply line disposed between a fluid supply and at least one sprinkler head. The first control valve is coupled to a second control valve that when open permits fluid to flow from the fluid supply through the fluid supply line to the at least one sprinkler head. The control circuit receives the pressure detected by the pressure sensor, evaluates a trigger condition indicative of the at least one sprinkler head being open based on the pressure detected by the pressure sensor, and responsive to the trigger condition being satisfied, causes the first control valve to open to reduce a chamber pressure in a chamber of the second control valve to cause the second control valve to open to permit fluid to flow from the fluid supply through the fluid supply line to the at least one sprinkler head.

Another implementation of the present disclosure is a method of operating an electronic accelerator. The method includes detecting, by a pressure sensor, a pressure in a fluid supply line disposed between a fluid supply and at least one sprinkler head. The method includes receiving, by a control circuit, the pressure detected by the pressure sensor. The method includes evaluating, by the control circuit, a trigger condition indicative of the at least one sprinkler head being open based on the pressure detected by the pressure sensor. The method includes causing, responsive to the trigger condition being satisfied, a first control valve to open to reduce a chamber pressure in a chamber of a second control valve to cause the second control valve to open, the second control valve when open permits fluid to flow from the fluid supply through the fluid supply line to the at least one sprinkler head.

Another implementation of the present disclosure is a fire sprinkler control circuit. The fire sprinkler control circuit includes one or more processors and a memory device storing processor-executable instructions that when executed by the one or more processors, cause the one or more processors to receive a pressure detected by a pressure sensor coupled to a fluid supply line disposed between a fluid supply and at least one sprinkler head; evaluate a trigger condition indicative of the at least one sprinkler head being open based on the pressure detected by the pressure sensor; and cause, responsive to the trigger condition being satisfied, a first control valve to open to reduce a chamber pressure in a chamber of a second control valve to cause the second control valve to open, the second control valve when open permits fluid to flow from the fluid supply through the fluid supply line to the at least one sprinkler head.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

The present disclosure relates generally to the field of automatic water control valves. More particularly, the present disclosure relates to an electronic accelerator for automatic water control valves. In some fire sprinkler systems, such as dry pipe sprinkler systems, a differential dry pipe valve that includes a mechanical clapper may be used to control fluid flow based on a pressure differential between a fluid side and an air side (corresponding to where a sprinkler head will open). However, the operation of the mechanical clapper may require the air side pressure to be a preset pressure (e.g., mathematically determined and set pressure) relative to the fluid side pressure. In some systems, differential dry pipe valves can be used to automatically control fluid outputted to dry pipe sprinklers; however, automatic control valves when properly configured may also control fluid outputted to dry pipe sprinkler systems. The present solution can allow for lower or higher air and/or water pressures to be used in the system, improving safety and reliability by optimizing water delivery time when using the electronic accelerator to control fluid flow delivery with automatic water control valves. The electronic accelerator can enable fluid to be more rapidly delivered to address a fire and/or delay delivery of fluid to a fire when applicable. The present solution can reduce the complexity of electronics required to operate the fire sprinkler system, such as complex electronics that would be required to electronically actuate the automatic water control valve based on a detected fixed pressure.

Figure 1:
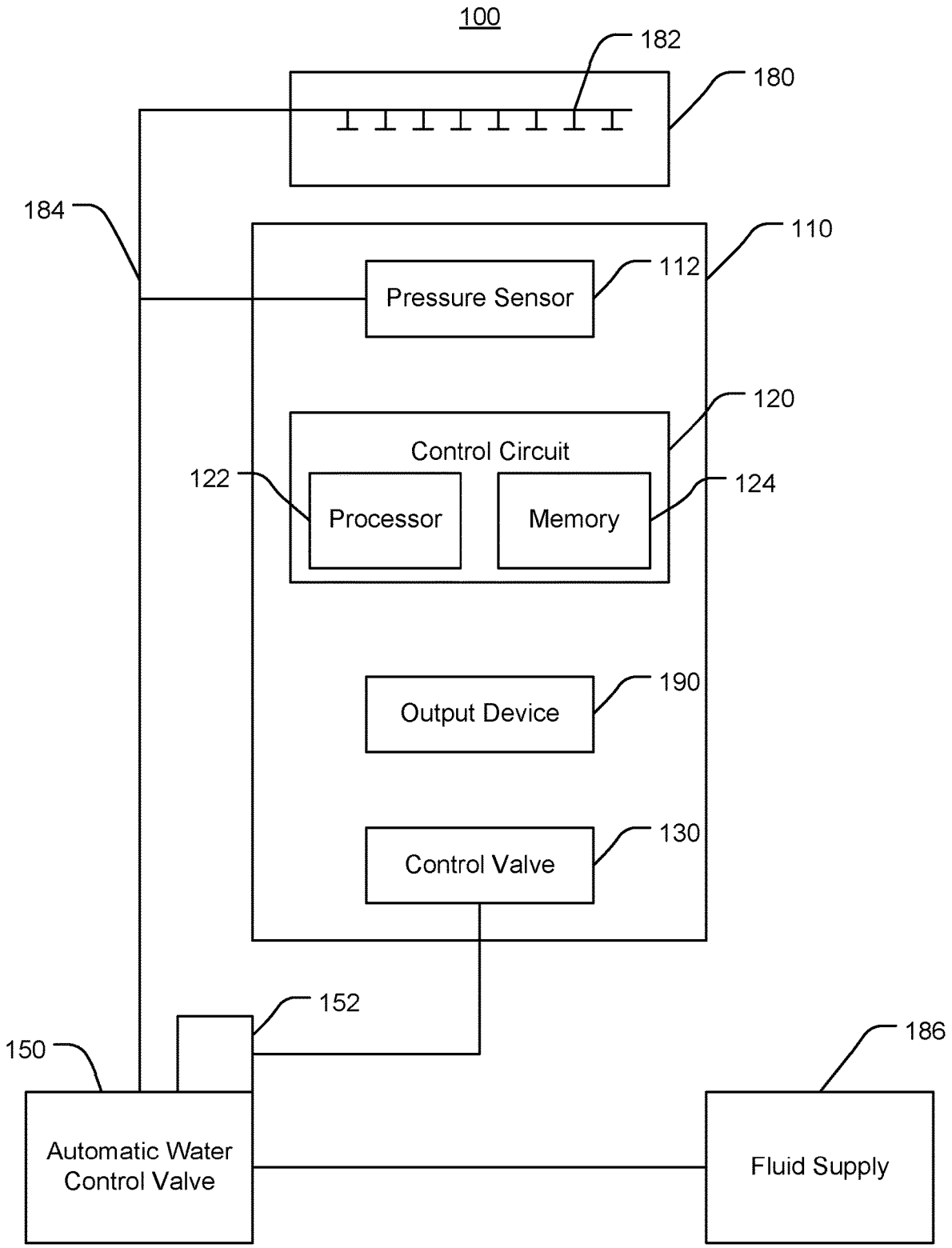
FIG. 1 is a block diagram of an electronically accelerated fire sprinkler system including an electronic accelerator according to an exemplary embodiment.
Figure 2:
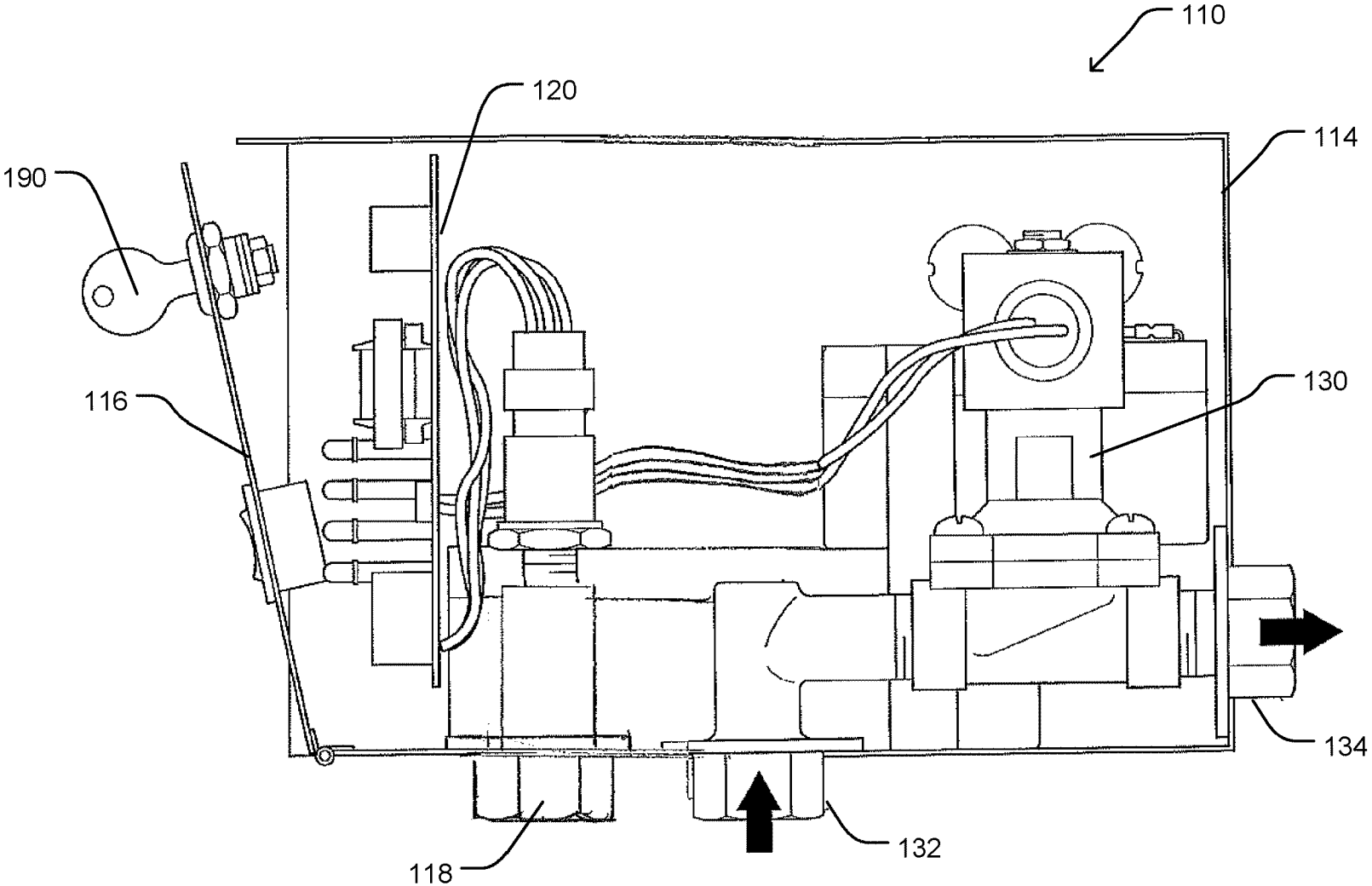
FIG. 2 is a cross section view of the electronic accelerator of FIG. 1 according to an exemplary embodiment.

Referring now to FIGS. 1-2, an electronically accelerated fire sprinkler system (EAFSS) 100 is depicted. The EAFSS 100 includes an electronic accelerator 110 coupled to an automatic water control valve 150 and a sprinkler grid 180. The electronic accelerator 110 can be retrofit to an existing fire sprinkler system (e.g., without making any electrical connections between the electronic accelerator 110 and components of the existing fire sprinkler system), such as by being coupled to the automatic water control valve 150 and to a fluid supply line 184 of the sprinkler grid 180.

The electronic accelerator 110 can include a housing 114 to in which a pressure sensor 112, a control circuit 120, and a control valve 130 are disposed. The electronic accelerator 110 can include an output device 190, which as depicted in FIG. 1 can be mounted to a removable cover 116 of the housing 114 depicted in FIG. 2. The electronic accelerator 110 can fluidly couple the control valve 130 to the automatic water control valve 150 via a control port 132 and to atmosphere via an atmosphere port 134. The electronic accelerator 110 can fluidly couple the pressure sensor 112 to the fluid supply line 184 via a supply port 118.

The sprinkler grid 180 can include a plurality of sprinkler heads 182. The sprinkler heads 182 are normally in a closed state. The sprinkler heads 182 can switch to an open state in response to a fire condition being detected, such as by being actuated to open when heated by a fire.

The sprinkler grid 180 is fluidly coupled to the automatic water control valve 150 via a fluid supply line 184. When one or more sprinkler heads 182 open, air or other fluids in the fluid supply line 184 can be outputted from the one or more sprinkler heads 182, which can reduce a system pressure in the fluid supply line 184 (e.g., reduce air pressure in the fluid supply line 184). For example, air in the fluid supply line 184 may be maintained at a pressure greater than an atmospheric pressure, such that air in the fluid supply line 184 flows out of the fluid supply line 184 via the one or more sprinkler heads 182 that have opened.

When the automatic water control valve 150 opens, fluid can be delivered from a fluid supply 186 through the fluid supply line 184 to the sprinkler grid 180. The automatic water control valve 150 can be coupled to a chamber 152. The chamber 152 can be a wet pilot chamber, such as a diaphragm chamber that is pressurized to apply a pressure against the automatic water control valve 150 to maintain the automatic water control valve 150 in a closed state. If the pressure in the chamber 152 is less than a threshold chamber pressure, the automatic water control valve 150 can open (e.g., switch to an open state) to allow the fluid to be delivered from the fluid supply 186 through the fluid supply line 184 to the sprinkler grid 180.

The electronic accelerator 110 includes the pressure sensor 112, which is fluidly coupled to the fluid supply line 184 to detect the system air pressure in the fluid supply line 184. The pressure sensor 112 can periodically or continually monitor the system air pressure in the fluid supply line 184. The pressure sensor 112 can be a pressure transducer. The pressure sensor 112 can output an indication of a pressure in the fluid supply line 184, such as by outputting a voltage corresponding to the pressure in the fluid supply line 184.

The electronic accelerator 110 includes the control circuit 120. The control circuit 120 includes a processor 122 and a memory 124. The processor 122 may be a general purpose or specific purpose processor, an application specific integrated circuit (ASIC), one or more field programmable gate arrays (FPGAs), a group of processing components, or other suitable processing components. The processor 122 may be configured to execute computer code or instructions stored in memory 124 (e.g., fuzzy logic, etc.) or received from other computer readable media (e.g., CDROM, network storage, a remote server, etc.) to perform one or more of the processes described herein. The memory 124 may include one or more data storage devices (e.g., memory units, memory devices, computer-readable storage media, etc.) configured to store data, computer code, executable instructions, or other forms of computer-readable information. The memory 124 may include random access memory (RAM), read-only memory (ROM), hard drive storage, temporary storage, non-volatile memory, flash memory, optical memory, or any other suitable memory for storing software objects and/or computer instructions. The memory 124 may include database components, object code components, script components, or any other type of information structure for supporting the various activities and information structures described in the present disclosure. The memory 124 may be communicably connected to the processor 122 via the control circuit 120 and may include computer code for executing (e.g., by processor 122) one or more of the processes described herein. The memory 124 can include various modules (e.g., circuits, engines) for completing processes described herein.

The control circuit 120 can receive the indication of the pressure in the fluid supply line 184 from the pressure sensor 112. The control circuit 120 can calculate a pressure parameter based on the received indication of the pressure. The control circuit 120 the indication of the pressure in the fluid supply line 184 as a voltage outputted by the pressure sensor 112, and convert the value indicative of the pressure in the fluid supply line to a value of the pressure parameter, such as by executing a calibration function. The control circuit 120 can calculate the pressure parameter to include at least one of an instantaneous pressure, an average pressure (e.g., a moving average pressure averaged over a plurality of instantaneous pressures) and a rate of change of pressure.

The control circuit 120 can evaluate a trigger condition based on the pressure parameter. The trigger condition can correspond to one or more sprinkler heads 182 being in the open state. The trigger condition may include a threshold value of the pressure parameter that corresponds to a trigger point for opening the automatic water control valve 150 so that fluid can be delivered to the sprinkler grid 180. The control circuit 120 can determine the trigger condition to be satisfied if the pressure parameter is less than the threshold value, or if the pressure parameter is less than or equal to the threshold value (e.g., depending on whether the threshold value is set to a maximum pressure in the fluid supply line 184 below which opening of the sprinkler head(s) 182 is understood to have occurred, or a maximum pressure at which opening of the sprinkler head(s) 182 is understood to have occurred). The control circuit 120 can determine the trigger condition to be satisfied based on a change in the system pressure in the fluid supply line 184, such as if a rate of change of the system pressure is less than (or less than or equal to) a threshold rate of change—the threshold rate of change being a value less than zero and thus indicative of the system pressure in the fluid supply line 184 decreasing.

The electronic accelerator 110 includes the control valve 130, which is fluidly coupled to the automatic water control valve 150. The control valve 130 can include a solenoid valve. The control valve 130 can be fluidly coupled to an outlet 132, which can allow fluid from the chamber 152 of the automatic water control valve 150 to be released via the outlet 132 when the control valve 130 is opened. When the fluid from the chamber 152 is released via the outlet 132, the automatic water control valve 150 can open (due to a decrease in the pressure applied against the automatic water control valve 150), and fluid from the fluid supply can be delivered to the sprinkler grid 180.

The control circuit 120 can actuate (e.g., open) the control valve 130 responsive to the trigger condition being satisfied. For example, if the control circuit 120 determines the system pressure in the fluid supply line 184 to be less than a threshold pressure at which one or more sprinklers heads 182 can be expected to have opened, the control circuit 120 can actuate the control valve 130. The control circuit 120 can actuate the control valve 130 by transmitting a control signal to the control valve 130, such as to energize the control valve 130. As such, the control circuit 120 can cause fluid from the fluid supply to be delivered to the sprinkler grid 180. In existing systems, the air in the fluid supply line 184 may be at a relatively high pressure to apply mechanical pressure against a fluid control device (e.g., a mechanical clapper) used to hold back fluid from being outputted through the fluid supply line 184. For example, a ratio of the air pressure in the fluid supply line 184 to fluid on an opposite side of the fluid control device from the fluid supply line 184 may be on the order of 6:1. The present solution can enable lower or higher air pressure to be used in the fluid supply line 184, as the control circuit 120 receives pressure data from the pressure sensor 112 based on air in the fluid supply line 184, and then controls operation of the control valve 130 based on the pressure data from the pressure sensor 112, rather than the EAFSS 100 using the air pressure in the fluid supply line 184 to maintain the automatic water control valve 150 in the closed state while also triggering the automatic water control valve 150 based on the air pressure in the fluid supply line 184. The system pressure in the fluid supply line 184 can be varied while maintaining the ability of the EAFSS 100 to improve and optimize fluid delivery time to address a fire.

The electronic accelerator 110 can include the output device 190, which can be used as an alarm indicator. The output device 190 can include at least one of a light and an audio output device. The control circuit 120 can evaluate an alarm condition based on the system pressure in the fluid supply line 184, and cause the output device 190 to output an alarm notification responsive to the alarm condition being satisfied. For example, the control circuit 120 can determine a low air alarm condition to be satisfied responsive to the system pressure in the fluid supply line 184 being less than (or less than or equal to) a low air pressure threshold. The control circuit 120 can determine a high air alarm condition to be satisfied responsive to the system pressure in the fluid supply line 184 being greater than (or greater than or equal to) a high air pressure threshold, which can be greater than the low air pressure threshold.

Figure 3:
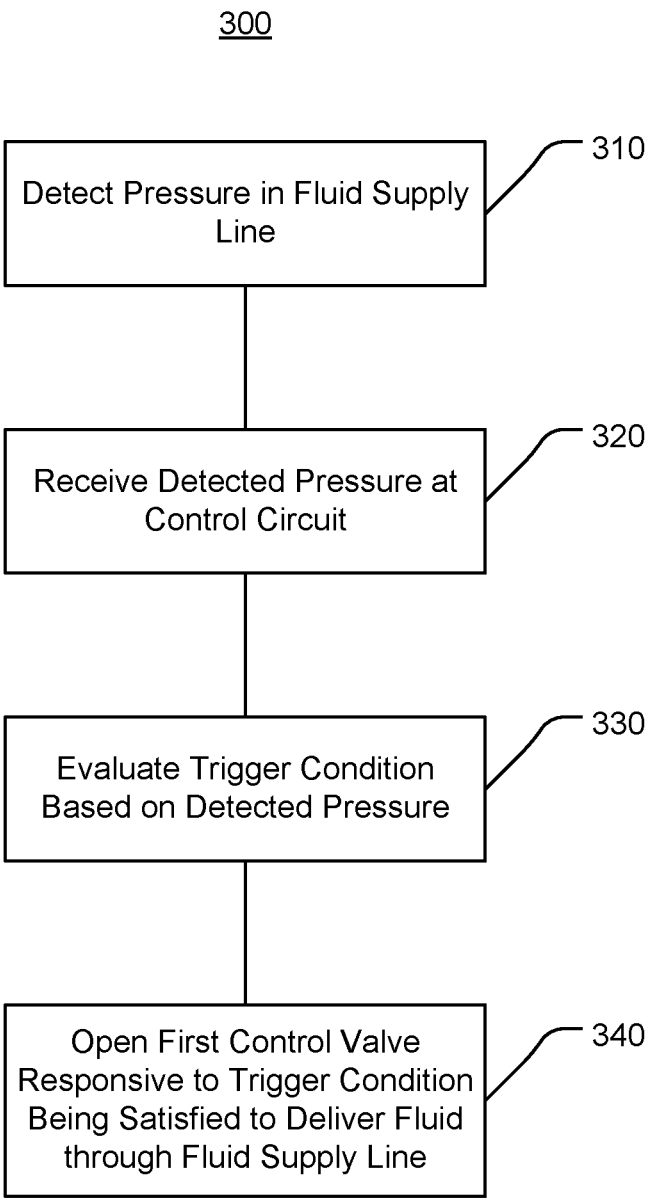
FIG. 3 is a flow diagram of a method of operating an electronic accelerator according to an exemplary embodiment.

Referring now to FIG. 3, a method 300 of operating an electronic accelerator is depicted. The method 300 can be performed by the EAFSS 100 described with references to FIGS. 1-2, such as by operating the electronic accelerator 110 of FIGS. 1-2.

At 310, a pressure in a fluid supply line is detected by a pressure sensor. The pressure sensor can include a pressure transducer. The fluid supply line can be disposed between a fluid supply and at least one sprinkler head.

At 320, the pressure detected by the control circuit is received by a control circuit. The control circuit can receive the pressure as a value indicative of the pressure in the fluid supply line (e.g., a voltage outputted by the pressure sensor) and convert the value indicative of the pressure in the fluid supply line to a pressure value, such as by executing a calibration function.

At 330, the control circuit evaluates a trigger condition based on the pressure detected by the pressure sensor. The trigger condition can be indicative of the at least one sprinkler head being open. For example, the trigger condition can be a threshold pressure, or threshold rate of change of pressure, below which it may be expected that one or more sprinkler heads have opened.

At 340, responsive to the trigger condition being satisfied, the control circuit causes a first control valve (e.g., a solenoid valve) to open. For example, the control circuit can transmit a control signal to cause the first control valve to open. The first control valve is fluidly coupled to a chamber of a second control valve (e.g., an automatic water control valve). The chamber can be a wet pilot chamber, such as a diaphragm pressurized to maintain the second control valve in a closed state. The second control valve can permit fluid to flow from the fluid supply through the fluid supply line to the at least one sprinkler head. As such, when control circuit causes the first control valve to open, fluid from the chamber can exit the chamber, allowing the second control valve to open and deliver fluid out of the at least one sprinkler head via the fluid supply line. The control circuit can cause the first control valve to open prior to the pressure in the fluid supply line being less than a fluid pressure in the fluid supply on an opposite side of the second control valve from the fluid supply line.

The control circuit can evaluate a low air alarm condition or high air alarm condition based on the indication of the pressure detected by the pressure sensor. The control circuit can cause an output device, such as a light or an audio output device, to output an indication of the low air alarm condition or high air alarm condition being satisfied.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. An electronic accelerator, comprising:

a pressure sensor coupled to a fluid supply line to detect a pressure in the fluid supply line, the fluid supply line disposed between a fluid supply and at least one sprinkler head;

a first control valve coupled to a second control valve that when open permits fluid to flow from the fluid supply through the fluid supply line to the at least one sprinkler head;

a control circuit to:

receive an indication of the pressure detected by the pressure sensor;

evaluate a trigger condition indicative of the at least one sprinkler head being open based on the pressure detected by the pressure sensor, the trigger condition is such that the first control valve is to open prior to the pressure in the fluid supply line being less than a fluid pressure in the fluid supply on an opposite side of the second control valve from the fluid supply line;

and responsive to the trigger condition being satisfied, cause the first control valve to open to reduce a chamber pressure in a chamber of the second control valve to cause the second control valve to open to permit fluid to flow from the fluid supply through the fluid supply line to the at least one sprinkler head; and a housing in which the pressure sensor, the first control valve, and the control circuit are disposed, the housing comprising:

an outlet coupled with the first control valve to couple the first control valve with the second control valve;

a supply port to couple the pressure sensor to the fluid supply line between the second control valve and the at least one sprinkler head; and an atmosphere port coupled with the first control valve to couple the chamber of the second control valve to atmosphere responsive to the first control valve opening.

2. The electronic accelerator of claim 1, comprising:

the pressure sensor includes a pressure transducer.

3. The electronic accelerator of claim 1, comprising:

the first control valve includes a solenoid valve.

4. The electronic accelerator of claim 1, comprising:

the second control valve includes an automatic water control valve.

5. The electronic accelerator of claim 1, comprising:

the trigger condition is satisfied when at least one of (i) the pressure detected by the pressure sensor is less than or equal to a threshold pressure and (ii) a rate of change of the pressure detected by the pressure sensor is less than or equal to a threshold rate of change.

6. The electronic accelerator of claim 1, comprising:

the control circuit outputs at least one of (i) a low air alarm responsive to detecting a low air alarm condition being satisfied based on the pressure detected by the pressure sensor and (ii) a high air alarm responsive to detecting a high air alarm condition being satisfied based on the pressure detected by the pressure sensor.

7. A method of operating an electronic accelerator, comprising:

detecting, by a pressure sensor disposed in a housing of the electronic accelerator via a supply port of the housing, a pressure in a fluid supply line disposed between a fluid supply and at least one sprinkler head;

receiving, by a control circuit disposed in the housing, an indication of the pressure detected by the pressure sensor;

evaluating, by the control circuit, a trigger condition indicative of the at least one sprinkler head being open based on the pressure detected by the pressure sensor; and causing, by the control circuit responsive to the trigger condition being satisfied, a first control valve to open to reduce a chamber pressure in a chamber of a second control valve to cause the second control valve to open, the first control valve disposed in the housing and coupled with an outlet of the housing coupled with the chamber of the second control valve, the trigger condition is such that the first control valve is to open prior to the pressure in the fluid supply line being less than a fluid pressure in the fluid supply on an opposite side of the second control valve from the fluid supply line, the second control valve when open permits fluid to flow from the fluid supply through the fluid supply line to the at least one sprinkler head, the first control valve coupled with an atmosphere port of the housing to couple the chamber of the second control valve to atmosphere.

8. The method of claim 7, comprising:

the pressure sensor includes a pressure transducer.

9. The method of claim 7, comprising:

the first control valve includes a solenoid valve.

10. The method of claim 7, comprising:

the second control valve includes an automatic water control valve.

11. The method of claim 7, comprising:

determining the trigger condition to be satisfied when at least one of (i) the pressure detected by the pressure sensor is less than or equal to a threshold pressure and (ii) a rate of change of the pressure detected by the pressure sensor is less than or equal to a threshold rate of change.

12. The method of claim 7, comprising:

outputting, by the control circuit, at least one of (i) a low air alarm responsive to detecting a low air alarm condition being satisfied based on the pressure detected by the pressure sensor and (ii) a high air alarm responsive to detecting a high air alarm condition being satisfied based on the pressure detected by the pressure sensor.

* * * * *